US005112105A

United States Patent [19]

Schmitt

[11] Patent Number: 5,112,105

[45] Date of Patent: May 12, 1992

[54] SAFETY PLAY CHAIR WITH ANTIPINCH HANDLE

[76] Inventor: Marcella H. Schmitt, 190 S. Wood Dale Rd., #706, Wood Dale, Ill. 60191

[21] Appl. No.: 678,816

[22] Filed: Apr. 1, 1991

Related U.S. Application Data

[63] Continuation-in-part of Ser. No. 376,417, Jul. 7, 1989, Pat. No. 5,004,297, which is a continuation-in-part of Ser. No. 328,088, Mar. 23, 1989, Pat. No. 4,988,090.

[51] Int. Cl.[5] ..... A42C 3/02

[52] U.S. Cl. ..... 297/270; 482/35; 472/116

[58] Field of Search ..... 272/113, 56.5 R; 297/247, 270

[56] References Cited

U.S. PATENT DOCUMENTS 3,780,469 12/1973 Hancovsky ..... 272/113 X

OTHER PUBLICATIONS

Whitney Brothers Co. Product Catalog © 1970, p. 3.
Playscape Incorporated, Dec. 11, 1968.
Miracle Recreation Equipment Co. Catalog 773.
Sweets Architect, File 1977 Sec. 2.15/mi.

*Primary Examiner*—Richard E. Chilcot, Jr.
*Attorney, Agent, or Firm*—Potthast & Ring

[57] ABSTRACT

A safety play chair (10) having a chair body (12) with a wall (12) closed inwardly upon itself to form upper (12A) and lower (12B) portions with inner and outer sides and a base (18R, 18L) for supporting the lower portion (12B) of the chair body (12) against tipping and rolling movement has an antipinch handle assembly including a rib (28) extending inwardly from an to an edge of the upper portion to an inner distal end (28') to which an antipinch handle (34, 35) is mounted to the rib (28). The handle has an outermost portion spaced inwardly from the outer side of the upper portion of the inwardly closed wall (12) by a sufficient distance (D) to prevent squeezing of a child's hand between the handle member (35) and underlying surface should the chair be upended.

15 Claims, 2 Drawing Sheets

SAFETY PLAY CHAIR WITH ANTIPINCH HANDLE

CROSS REFERENCE TO RELATED APPLICATION

This application is a continuation in part of my application Ser. No. 07/376,417 filed Jul. 7, 1989, now U.S. Pat. No. 5,004,297 issued Apr. 2, 1991, which is a continuation in part of U.S. application Ser. No. 07/328,088 filed Mar. 23, 1989, now U.S. Pat. No. 4,988,090 issued Jan. 29, 1991.

TECHNICAL BACKGROUND

This invention relates to a safety play chair and more particularly to such a chair having an inwardly closed wall defining a chair body for underlying support of a person reposed therein.

In the aforementioned U.S. Pat. No. 5,004,297 to be issued to Schmitt on Apr. 2, 1991, of which this is a continuation-in-part application, a safety play chair is disclosed having a chair body supported on a base and defined by an inwardly closed wall with a pair of openings on opposite sides and a handle adjacent the openings. This handle functioned well, for its primarily intended function of assisting children to raise or lower themselves into and out of the chair body. However, a disadvantage of this handle is that when the chair is upended to enable it to be rocked back and forth on its outer curved surface, if the handle is held by the child, it can pinch or squeeze the child's fingers against the floor or other surface on which it is being rocked.

SUMMARY OF THE INVENTION

Thus, the principal object of the present invention is to provide a safety play chair of the general type described in U.S. Pat. No. 5,004,297 with an improved antipinch handle assembly which overcomes the aforementioned problem of the handle pinching or squeezing the child's fingers between the handle and the floor.

It is therefore an object of the present invention to provide in a safety play chair having a chair body including a wall closed inwardly upon itself to form upper and lower portions with inner and outer sides and a length extending between a pair of opposite edges of the wall and a base for supporting the lower portions of the chair, an antipinch handle assembly comprising a rib extending inwardly from an edge of the inwardly closed wall to an inner distal end and a handle member mounted to the rib at the inner distal end and having an outermost portion spaced inwardly from the outer side of the upper portion of the inwardly closed wall.

It is also an object to provide a safety play chair comprising a chair body, an inwardly closed wall with a pair of opposite sides and an upper portion with a curved outer surface, an opening at one of the pair of opposite sides for entry of a person to repose within the inwardly closed wall and a handle mounted to the chair body adjacent the opening with an outermost portion spaced inwardly of the curved outer surface.

BRIEF DESCRIPTION OF THE DRAWING

The foregoing objects and advantageous features of the invention will be explained in greater detail and others will be made apparent from the detailed description of the preferred embodiment of the present invention which is given with reference to the several figures of the drawing, in which.

DETAILED DESCRIPTION

Figure 2:
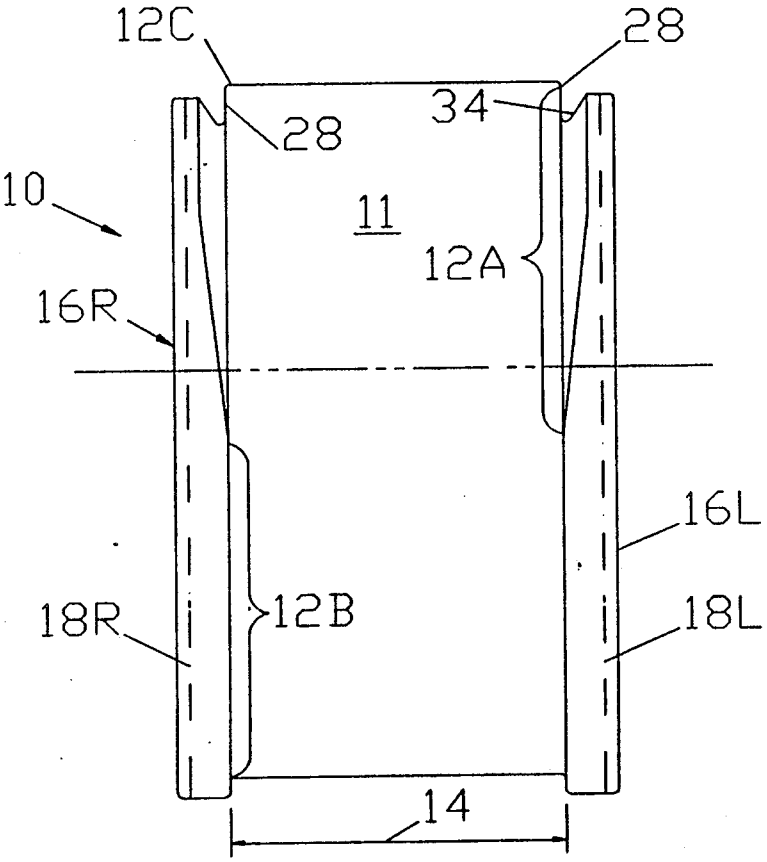
FIG. 2 is an enlarged side view of the safety play chair of FIG. 1.
Figure 1:
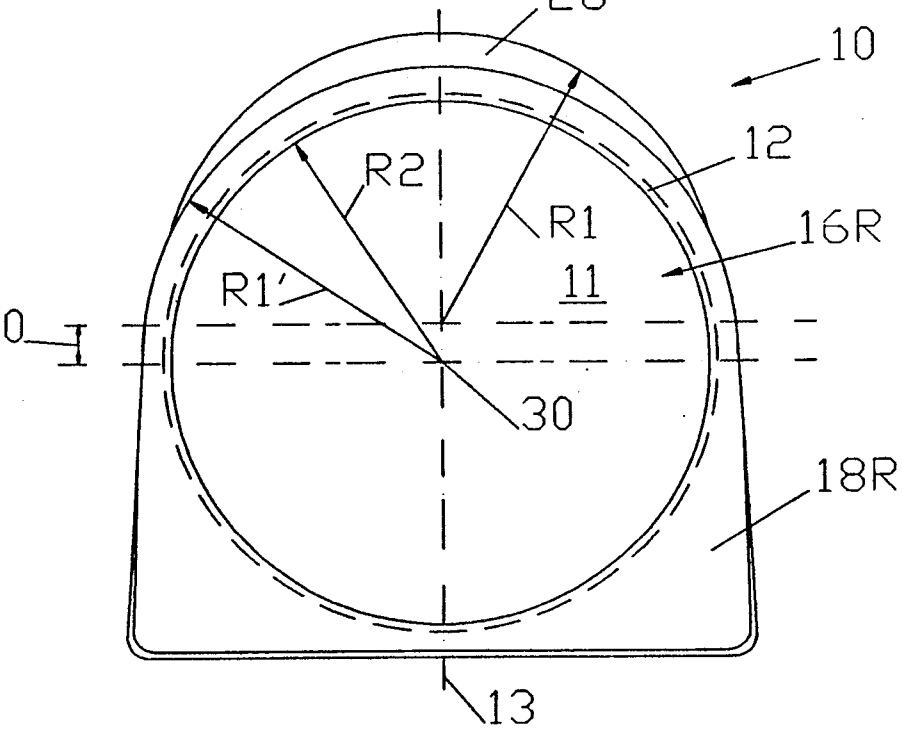
FIG. 1 is a front view of a preferred embodiment of the safety chair of the present invention.
Figure 3A:
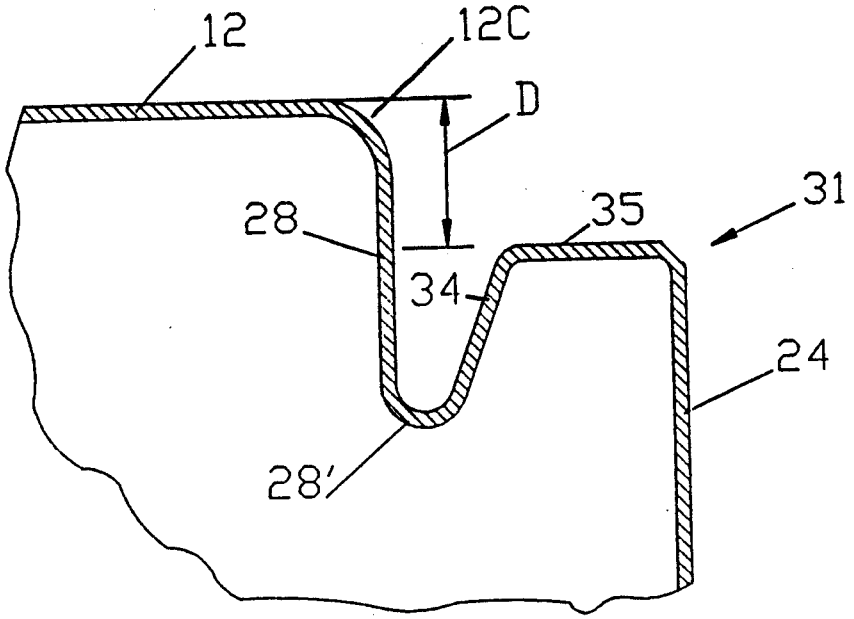
FIG. 3A is an enlarged cross-sectional view of the handle assembly FIGS. 1 and 2.

Referring now to FIGS. 1, 2 and 3A, the preferred embodiment of the play chair 10 has a chair body 11 with a smooth, glass-like, impact and splinter resistant, closed, concave, or inwardly curved, or inwardly turned, interior wall, or curved wall, 12. Wall 12 is closed inwardly upon itself to form an upper portion 12A and a lower portion 12B of the chair body 11, FIG. 2. The wall 12 is preferably of uniform width 14 throughout and has an interior cylindrical surface at least in the lower portion, if not throughout. It has outer and inner sides and a uniform length which extends between a pair of opposite edges 12C, FIGS. 2 and 3A. In such case, openings 16R and 16L on opposite sides of the wall 12 are circular, having a radius R1 of approximately fifteen inches for a width 14 of approximately fifteen inches. This has been found to be the optimum size and ratio between width 14 and the opening size for children from ages three to six years to give them both comfort and a sense of security.

The entire chair of a thin wall construction, being made of relatively thin walls having a thickness of on the order of less than two orders of magnitude less than the diameter of the opening 16R and 16L in order to minimize the weight of the chair 10 to enhance portability and to reduce the cost of material. The material is preferably polyethylene, polyvinyl or other like impact resistant, relatively rigid, smooth plastic. On the other hand, it is of particular importance to keep the weight of the top portion 12A as low as possible in order to optimize stability of the chair, but the top portion must also have sufficient strength to preclude inward collapse under normal loading conditions. The entire chair 10 is preferably manufactured as a single integrated item by means of molding, preferably rotational molding.

The chair body 11 is supported against tipping and rolling movement by means of a base having a pair of mirror imaged, but otherwise identical, base sections 18L and 18R at the left and right sides, respectively. Generally, the chair 10 has an axis of symmetry 13 passing through the middle of the side and through the chair 10 midway between openings 16R and 16L.

It is necessary for the upper portion 12A of the wall 12 to have sufficient strength to prevent collapse in the event of top loading by means of a person sitting on top, for instance. Both the thin wall construction and the necessary strength against collapse are achieved together by means of a thin walled rib 28 attached to the upper portion 12A of the wall 12 adjacent the opening 16R and extending inwardly therefrom.

Advantageously, and in keeping with the principal object of the present invention, this rib 28 forms part of an antipinch handle assembly 30. The rib 28 is formed only in the upper portion 12A where it is needed. It has a shape defined by an approximate crescent resulting from intersection of the circle of radius R1, which defines the upper portion 12A of wall 12, and another circle of a radius R1, which is the same length as radius R1 but which is centered at a point 30 vertically offset a distance of approximately one inch. This offset distance is equal to the maximum depth of the rib 28 at the uppermost portion of upper part 12A of body 12 and is also approximately equal to the difference in the length of the radius R1 and a radius R1 which defines the outermost edge of a rim assembly, or rim 24. Thus, the depth of the rib gradually varies from a maximum at the uppermost part of the upper portion 12A, where maximum strength is required, to a minimum, or zero depth, at approximately midpoint where the reinforcement against vertical loads is no more required.

Referring to FIG. 3A, the antipinch handle assembly also includes a beveled wall 34 interconnecting the inwardly turned rib 28 and the rim 24, best seen in FIG. 3A. Another handle member, or grip, 35 extends axially between the beveled wall 34 and the rim 24. The beveled wall 34 and handle member 35 form part of a convenient hand grip for a child to raise and lower themselves through the opening 16R or 16L. As best seen in FIG. 2, the width of the handle member 35 increases from a minimum adjacent the uppermost part of upper portion 12A where the depth of the rib 28 is greatest to a maximum width at the middle axis, as best seen in FIG. 2. As best seen in FIG. 3A, the rib 28 and beveled wall 34 define an acute angle 36 with one another which faces generally upwardly.

Referring to FIG. 3A, in keeping with the principal objective of the invention, the uppermost part of the handle member 35 is seen to be inwardly spaced from the uppermost part of the outer side of the wall 12 by a distance D to prevent a person's fingers on handle grip member 35 to be crushed between the wall 12 or member 35 and an underlying surface should the chair be upended and rocked on the curved outer surface of upper portion 12A. A minimum distance D of approximately one inch has been found sufficient to protect the fingers of a child of ages three to six against being pinched, but it should be appreciated that larger distances could be employed. Also, while it is seen that the antipinch handle member assembly elements 34 and 35 are mounted to the rib 28 at an inner distal end 28', the handle is not necessarily mounted in this fashion. Preferably, the outer side 12, however, is integrally formed together with the handle assembly 30.

It should be appreciated, that as the depth of the rib 28 decreases, the handle member becomes spaced inwardly from the outer side of the upper portion 12A of the inwardly turned wall 12 by an amount which varies from a maximum spacing at the uppermost part of the body 12 to a minimum spacing adjacent the lower portion 12A. In order to further eliminate risk of injury, the inner connections between the plurality of handle elements, rib 28, beveled wall 34 and hand grip 35 are interconnected by rounded edges or corners, as best seen in FIG. 3. As shown in FIG. 2, preferably handles are provided on both sides of the chair.

Figure 3B:
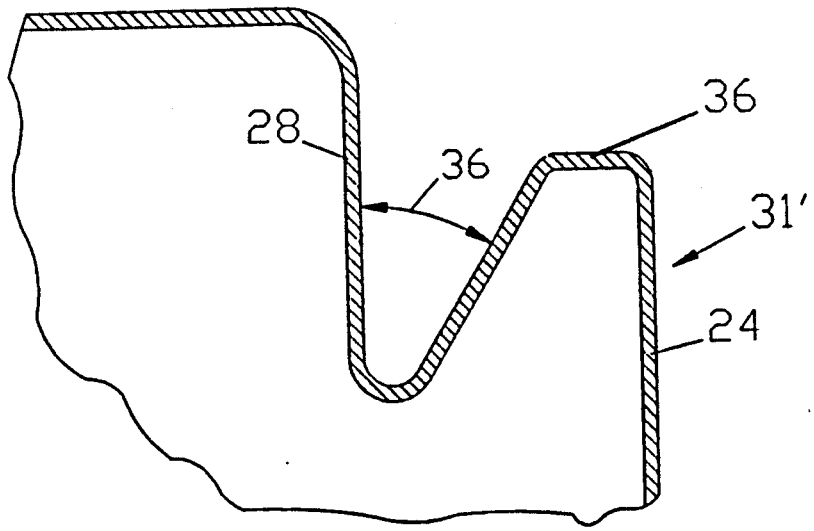
FIG. 3B is an enlarged cross-sectional view of an alternate embodiment of the handle assembly of the type shown in FIG. 3A.

The preferred dimensions and configuration of the antipinch handle assembly 31 are illustrated in FIG. 3A. FIG. 3B illustrates another handle assembly 31' which can also be employed in which the acute angle formed between rib 28 and beveled wall 34, angle 36, is increased, and the depth of grip 35 is decreased.

While a preferred embodiment has been disclosed in detail, it should be appreciated that the scope of the invention is not so limited but is defined by the appended claims.

I claim:

1. In a safety play chair having a chair body including a wall closed inwardly upon itself to form upper and lower portions, said inwardly closed wall forming inner and outer sides and having a length extending between a pair of opposite edges of the wall, and a base for supporting the lower portions of the chair body against tipping and rolling movement, the improvement being an antipinch handle assembly, comprising:

a rib extending inwardly from an edge of the inwardly closed wall to an inner distal end; and a handle member mounted to the rib at the inner distal end and having an outermost portion spaced inwardly from the outer side of the upper portion of the inwardly closed wall.

2. The safety play chair of claim 1 in which the handle member forms an acute angle with the rib facing outwardly.

3. The safety play chair of claim 1 in which said inwardly extending rib has a depth which varies from a maximum at an uppermost part of the upper portion of the inwardly closed wall to a minimum at a lowermost part of the upper portion of the wall.

4. The portable, safety play chair of claim 1 in which said outer side of the upper portion of the inwardly curved wall is integral with the handle member and the rib.

5. The safety play chair of claim 1 in which at least part of said inwardly closed wall is curved.

6. The safety play chair of claim 1 in which the handle member is spaced inwardly from the outer side of the upper portion of the inwardly turned wall by an amount which varies from a maximum spacing at an uppermost part of the body to a minimum spacing adjacent the lower portion of the body.

7. The safety play chair of claim 6 in which the handle member has a width which varies from a minimum adjacent an uppermost of the inwardly closed wall to a maximum adjacent the lower portion.

8. The safety play chair of claim 1 in which the handle member is spaced from the outer side of the wall at least at the upper portion by an amount not less than the average thickness of a child's finger between ages three and six.

9. The safety play chair of claim 1 in which said handle has a plurality of handle elements interconnected at rounded edges.

10. A safety play chair, comprising:

a chair body including an inwardly closed wall with a pair of opposite sides and an upper portion with a curved outer surface;

an opening at one of the pair of opposite sides for entry of a person to repose within the inwardly closed wall; and a handle mounted to the chair body adjacent the opening with an outermost portion spaced inwardly of the curved outer surface.

11. The safety play chair of claim 10 in which said handle and chair body are integral.

12. The safety play chair of claim 10 in which the chair body includes a reinforcing rib adjacent said opening and said handle is mounted to the reinforcing rib.

13. The safety play chain of claim 10 including a second opening at the other of the pair of opposite sides, and another handle mounted adjacent the second opening with an outermost portion spaced inwardly of the curved outer surface.

14. The safety play chair of claim 10 in which the curved surface is substantially cylindrical.

15. The safety play chair of claim 10 in which the inwardly closed wall is a smoothly curved wall closed inwardly upon itself.

* * * * *

UNITED STATES PATENT AND TRADEMARK OFFICE

CERTIFICATE OF CORRECTION

PATENT NO. : 5,112,105

DATED : 5/12/92

INVENTOR(S) : MARCELLA H. SCHMITT

It is certified that error appears in the above-identified patent and that said Letters Patent is hereby corrected as shown below:

Col. 2, line 4, after "safety" and before "chair" insert -play-;

line 8, after "assembly" and before "FIGS." insert -of-;

Col. 3, line 2, change "R1" to -R1'-;

line 4, after "distance" and before "of" insert -0-;

line 8, change second "R1" to -R2-;

lines 14-15, after "assembly" and before "also" insert -31-;

line 44, change "30" to --31--.

Col. 4, line 58, change "chain" to --chair--.

Signed and Sealed this

Twenty-fourth Day of August, 1993

Bruce Lehman

*Attest:*

BRUCE LEHMAN

*Attesting Officer*

*Commissioner of Patents and Trademarks*